US009099280B2

(12) United States Patent
Jeong et al.

(10) Patent No.: US 9,099,280 B2
(45) Date of Patent: Aug. 4, 2015

(54) X-RAY TUBE AND METHOD OF CONTROLLING X-RAY FOCAL SPOT USING THE SAME

(71) Applicant: ELECTRONICS AND TELECOMMUNICATIONS RESEARCH INSTITUTE, Daejeon (KR)

(72) Inventors: Jin Woo Jeong, Daejeon (KR); Yoon-Ho Song, Daejeon (KR); Sungyoul Choi, Ulsan (KR); Jun Tae Kang, Daegu (KR); Jae-woo Kim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 200 days.

(21) Appl. No.: 13/762,274

(22) Filed: Feb. 7, 2013

(65) Prior Publication Data

US 2013/0336461 A1 Dec. 19, 2013

(30) Foreign Application Priority Data

Jun. 18, 2012 (KR) ..... 10-2012-0064758

(51) Int. Cl.
*H01J 35/14* (2006.01)

(52) U.S. Cl.
CPC ..... *H01J 35/14* (2013.01)

(58) Field of Classification Search
CPC ..... H01J 35/14; H01J 35/00
USPC ..... 378/119, 121, 138
See application file for complete search history.

(56) References Cited

U.S. PATENT DOCUMENTS

2003/0099327 A1* 5/2003 Matsushita et al. ..... 378/138
2009/0245468 A1* 10/2009 Zou et al. ..... 378/122

FOREIGN PATENT DOCUMENTS

KR 10-2009-0012910 A 2/2009

* cited by examiner

*Primary Examiner* — Courtney Thomas

(57) ABSTRACT

An X-ray tube is provided. The X-ray tube includes a cathode electrode which is disposed in one end of a vacuum container and includes an emitter emitting an electron; a gate electrode which is disposed in the vacuum container to be adjacent to the cathode electrode; an anode electrode which is disposed in the vacuum container of the other end of a direction in which the vacuum container extends and inclines with respect to the cathode electrode; and a focusing electrode which is disposed in the vacuum container along an inner circumference surface of the vacuum container between the gate electrode and the anode electrode. The focusing electrode has an opening of which a plan cross section has a maximum width and a minimum width different from each other.

12 Claims, 14 Drawing Sheets

X-RAY TUBE AND METHOD OF CONTROLLING X-RAY FOCAL SPOT USING THE SAME

CROSS-REFERENCE TO RELATED APPLICATIONS

This U.S. non-provisional patent application claims priority under 35 U.S.C. §119 of Korean Patent Application No. 10-2012-0064758, filed on Jun. 18, 2012, the entire contents of which are hereby incorporated by reference.

BACKGROUND

The present inventive concept herein relates to X-ray tubes, and more particularly, to an X-ray tube that can minimize an X-ray focal spot size and a method of controlling an X-ray focal spot using the same.

An X-ray tube using a cold cathode electron source as an emitter generates electrons from the emitter by a mesh type gate electrode disposed in a vacuum container and accelerates the generated electrons by several to several hundreds of kilovolts to make the accelerated electrons strike a target anode electrode. As a result, an X-ray is generated. The generated X-ray includes a characteristic X-ray determined by a unique characteristic of material used in the target anode electrode and a continuous X-ray generated by deceleration of the accelerated electrons. At this time, at least one focusing electrode is selectively added between the anode electrode and a gate electrode to make an electron beam focus on one point of the anode electrode.

SUMMARY

Embodiments of the inventive concept provide an X-ray tube. The X-ray tube may include a cathode electrode which is disposed in one end of a vacuum container and includes an emitter emitting an electron; a gate electrode which is disposed in the vacuum container to be adjacent to the cathode electrode; an anode electrode which is disposed in the vacuum container of the other end of a direction in which the vacuum container extends and inclines with respect to the cathode electrode; and a focusing electrode which is disposed in the vacuum container along an inner circumference surface of the vacuum container between the gate electrode and the anode electrode. The focusing electrode has an opening of which a plan cross section has a maximum width and a minimum width different from each other.

Embodiments of the inventive concept also provide a method of controlling an X-ray focal spot of an X-ray tube having the structure described above. The method may include changing the maximum width or the minimum width of the plan cross section of the opening of the focusing electrode.

BRIEF DESCRIPTION OF THE FIGURES

Preferred embodiments of the inventive concept will be described below in more detail with reference to the accompanying drawings. The embodiments of the inventive concept may, however, be embodied in different forms and should not be constructed as limited to the embodiments set forth herein. Rather, these embodiments are provided so that this disclosure will be thorough and complete, and will fully convey the scope of the inventive concept to those skilled in the art. Like numbers refer to like elements throughout.

DETAILED DESCRIPTION OF THE EMBODIMENTS

Figure 1:
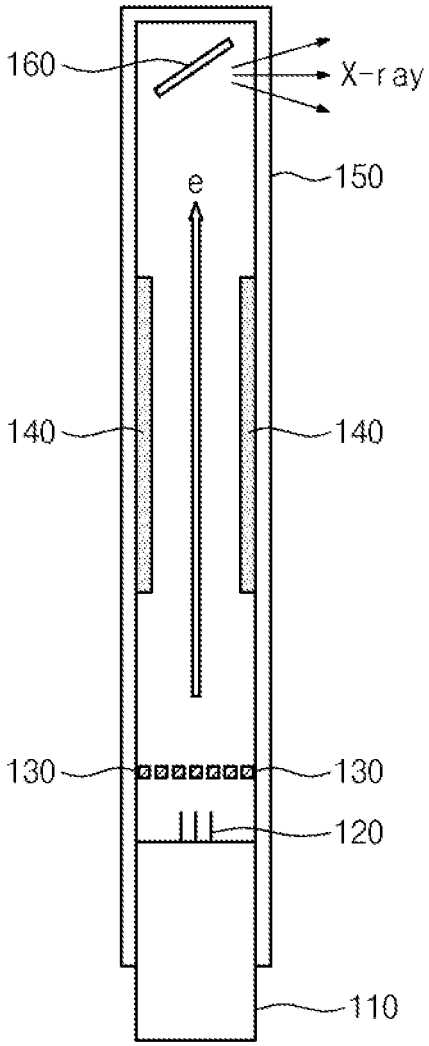
FIG. 1 is a cross sectional view for explaining the constitution of an X-ray tube in accordance with some embodiments of the inventive concept.

Embodiments of inventive concepts will be described more fully hereinafter with reference to the accompanying drawings, in which embodiments of the invention are shown. This inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. In the drawings, the size and relative sizes of layers and regions may be exaggerated for clarity. Like numbers refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will also be understood that when an element such as a layer, region or substrate is referred to as being "on" or "onto" another element, it may lie directly on the other element or intervening elements or layers may also be present. Like reference numerals refer to like elements throughout the specification.

Embodiments of the inventive concept may be described with reference to cross-sectional illustrations, which are schematic illustrations of idealized embodiments of the present invention. As such, variations from the shapes of the illustrations, as a result, for example, of manufacturing techniques and/or tolerances, are to be expected. Thus, embodiments of the present invention should not be construed as limited to the particular shapes of regions illustrated herein, but are to include deviations in shapes that result from, e.g., manufacturing. For example, a region illustrated as a rectangle may have rounded or curved features. Thus, the regions illustrated in the figures are schematic in nature and are not intended to limit the scope of the present invention.

Figure 2:
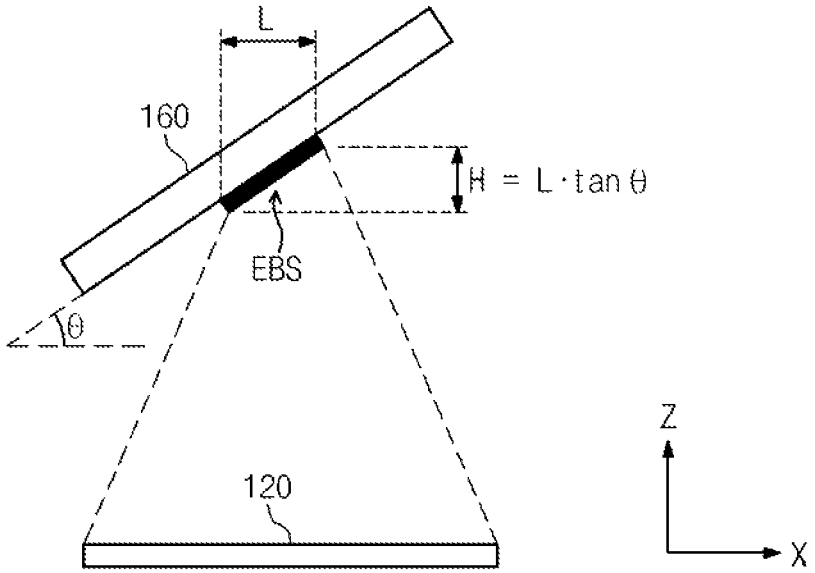
FIGS. 2 through 4 are conceptual views for explaining a drive of X-ray tube.
Figure 3:
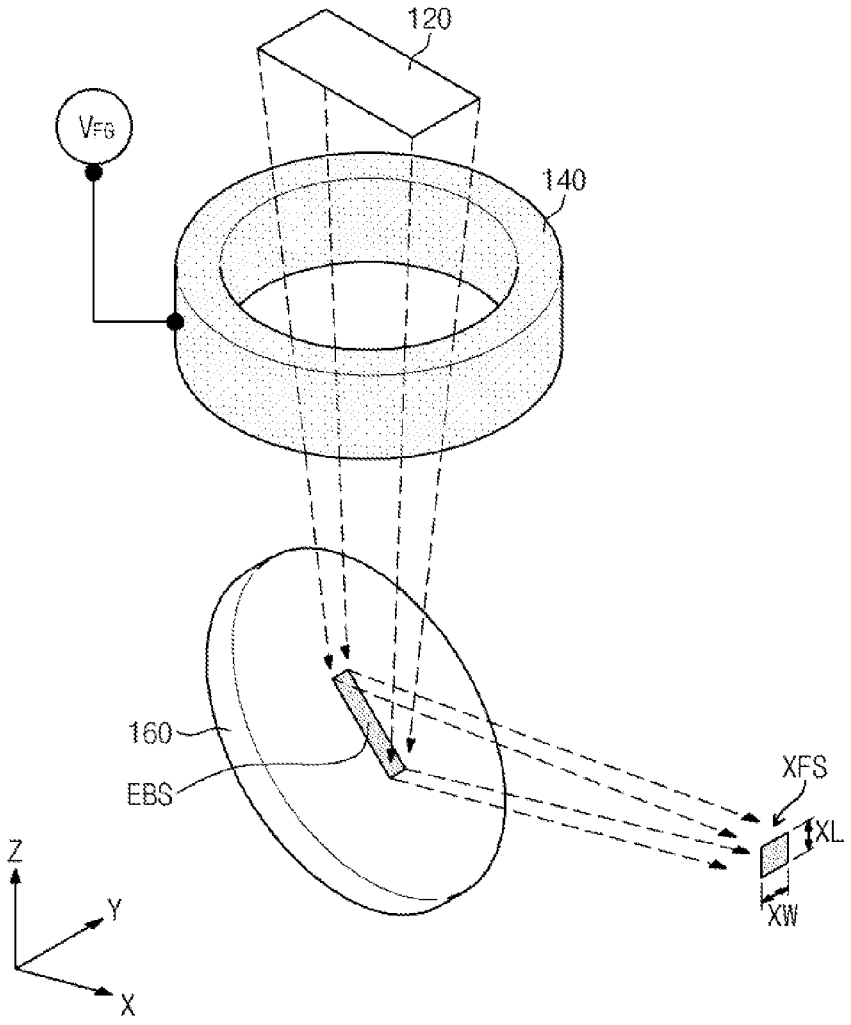
Figure 4:
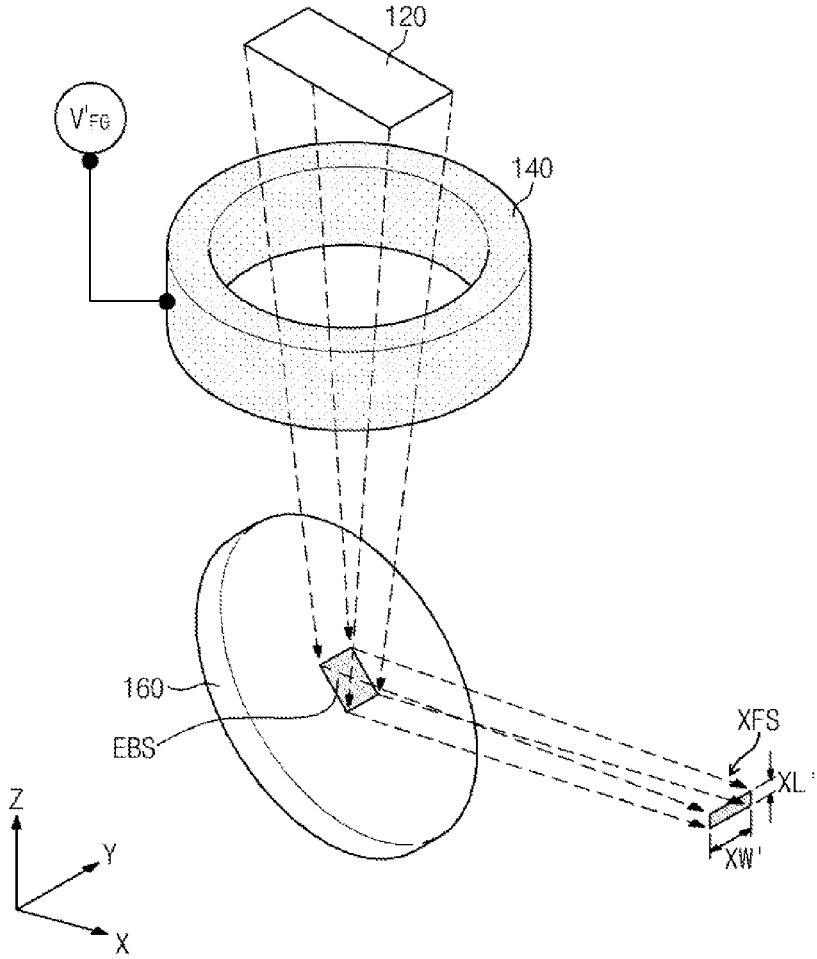

FIG. 1 is a cross sectional view for explaining the constitution of an X-ray tube in accordance with some embodiments of the inventive concept. FIGS. 2 through 4 are conceptual views for explaining a drive of X-ray tube.

Referring to FIG. 1, an X-ray tube may include a vacuum container 150, a cathode electrode 110 which is disposed in one end of the vacuum container 150 and includes an emitter 120 emitting an electron (e), a gate electrode 130 which is disposed in the vacuum container 150 and is disposed to be adjacent to the cathode electrode 110, an anode electrode 160 which is disposed in the other end of the vacuum container 150 and inclines with respect to the cathode electrode 110, and a focusing electrode 140 which is disposed in the vacuum container 150 along an inner circumference surface of the vacuum container 150 between the gate electrode 130 and the anode electrode 160.

Since the anode electrode 160 inclines at a specific angle with respect to the cathode electrode 110, the X-ray tube in accordance with some embodiments of the inventive concept may be a reflection-type X-ray tube.

Emission of electron (e) and focusing of an electron beam (broad arrow) from the emitter 120 of the cathode electrode 110 are done by an electric field. The gate electrode 130 and the focusing electrode 140 perform emission of electron (e) and focusing of the electron beam (broad arrow).

A structure and a size of the vacuum container 150 of the X-ray tube and locations and sizes of the gate electrode 130 and the focusing electrode 140 may be changed by use of the electron beam (broad arrow). An X-ray tube using a general cold cathode electron source uses the mesh type gate electrode 130 disposed inside the vacuum container 150.

Referring to FIGS. 2 through 4, a general reflection-type X-ray tube generates an X-ray when the electron beam emitted from the emitter 120 which is an electron source is focused on and collides with the anode electrode 160 which inclined at an angle of θ. At this time, the emitter 120 may be a hot cathode electron source such as filament or a cold cathode electron source such as field emission emitter. The field emission emitter may be a carbon allotrope such as carbon nanotube.

Due to the anode electrode 160 which inclined at an angle of θ, a length XL of z direction of an X-ray focal spot XFS is reduced to a tangent component of a length L of x direction of a focused electron beam spot EBS (refer to formula of FIG. 2). Thus, the electron beam spot EBS which is focused on the anode electrode 160 by the electro static focusing electrode 140 has to become a form having a minimum width and a maximum width different from each other so that the length XL of z direction of the X-ray focal spot XFS is the same with a length XW of y direction of the X-ray focal spot XFS. The above description is equally applied to an emitter and an electron beam spot having an elliptical shape, but in FIGS. 2 through 4, the emitter 120 and the electron beam spot EBS having a rectangular shape are illustrated.

If a voltage $V'_{FG}$ of FIG. 4 obtained by controlling a voltage $V_{FG}$ applied to the focusing electrode 140 is applied to the focusing electrode 140 to further focus the electron beam, the focused electron beam has a square shape and thereby an X-ray focal spot XFS of rectangular shape that a length XW' of y direction is greater than a length XL' of x direction is generated. The X-ray focal spot XFS of rectangular shape may cause blur of image when imaging an object using the X-ray.

Figure 5:
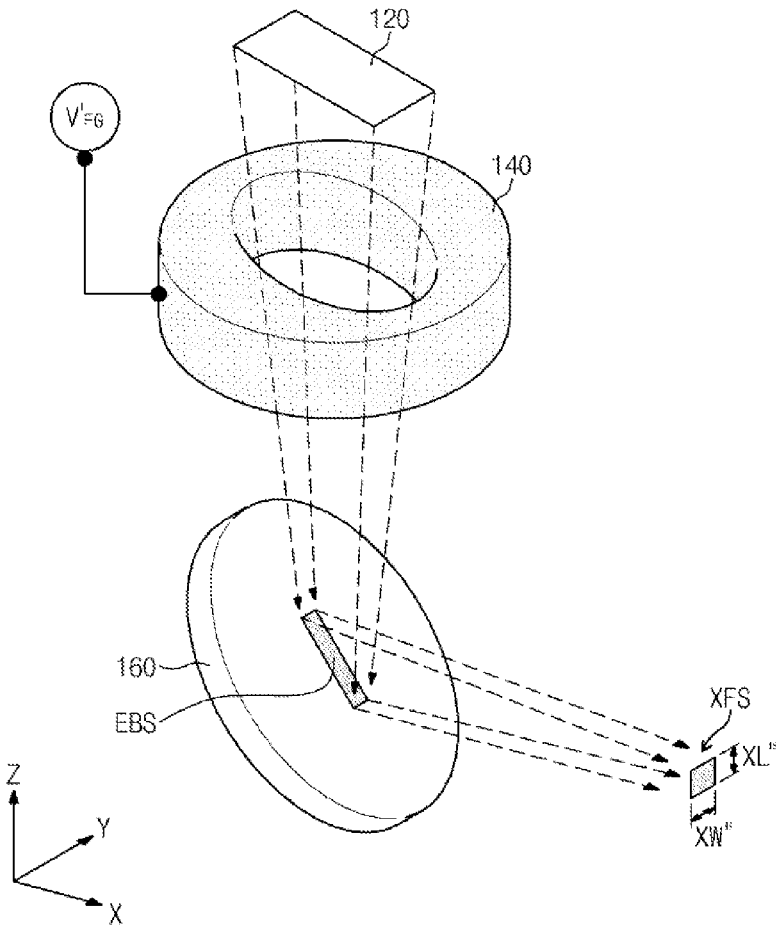
FIG. 5 is a conceptual view for explaining a drive of X-ray tube in accordance with some embodiments of the inventive concept.

FIG. 5 is a conceptual view for explaining a drive of X-ray tube in accordance with some embodiments of the inventive concept.

Referring to FIG. 5, the X-ray tube may include an anode electrode 160 that inclined at a specific angle, a focusing electrode 140 having an opening that its plan cross section has a maximum width in an inclined direction of the anode electrode 160 and an emitter 120 that its plan cross section has a maximum width in an inclined direction of the anode electrode 160.

A plan cross section of the opening of the focusing electrode 140 may have an elliptical shape or a polygonal shape. It may be desirable that the plan cross section of the opening has an elliptical shape or a rectangular shape. A size of the opening may be determined by a size of the emitter 120, a location of the focusing electrode 140 between the emitter 120 and the anode electrode 160 and an inclined angle of the anode electrode 160.

Since an electron beam focusing characteristic of the X-ray tube is dependent on a shape and a size of the nearest surface of the focusing electrode 140 to the anode electrode 160, the plan cross section of the opening may be produced to have a minimum width and the maximum width different from each other.

In the case that like FIG. 3, the opening of the focusing electrode 140 has a plan cross section of the same width, since among electron beams emitted from the emitter 120 that its plan cross section has a maximum width and a minimum width different from each other, an electron beam of the maximum width direction is closer to the focusing electrode 140, it is more affected by an electric field applied to the focusing electrode 140 like FIG. 4. Thus, a shape of the electron beam spot EBS becomes a square and thereby a shape of the X-ray focal spot XFS becomes a long rectangle like.

However, if like FIG. 5, the opening of the focusing electrode 140 has a plan cross section of a maximum width and a minimum width different from each other, an electron beam of a maximum width direction of the emitter 120 may be less affected by an electric field of the focusing electrode 140 and an electron beam of a minimum width direction of the emitter 120 may be more affected by the electric field of the focusing electrode 140. Thus, since the electron beam spot EBS becomes a form that has a maximum width and a minimum width different from each other, the X-ray focal spot XFS may become a form having the same width.

Figure 6:
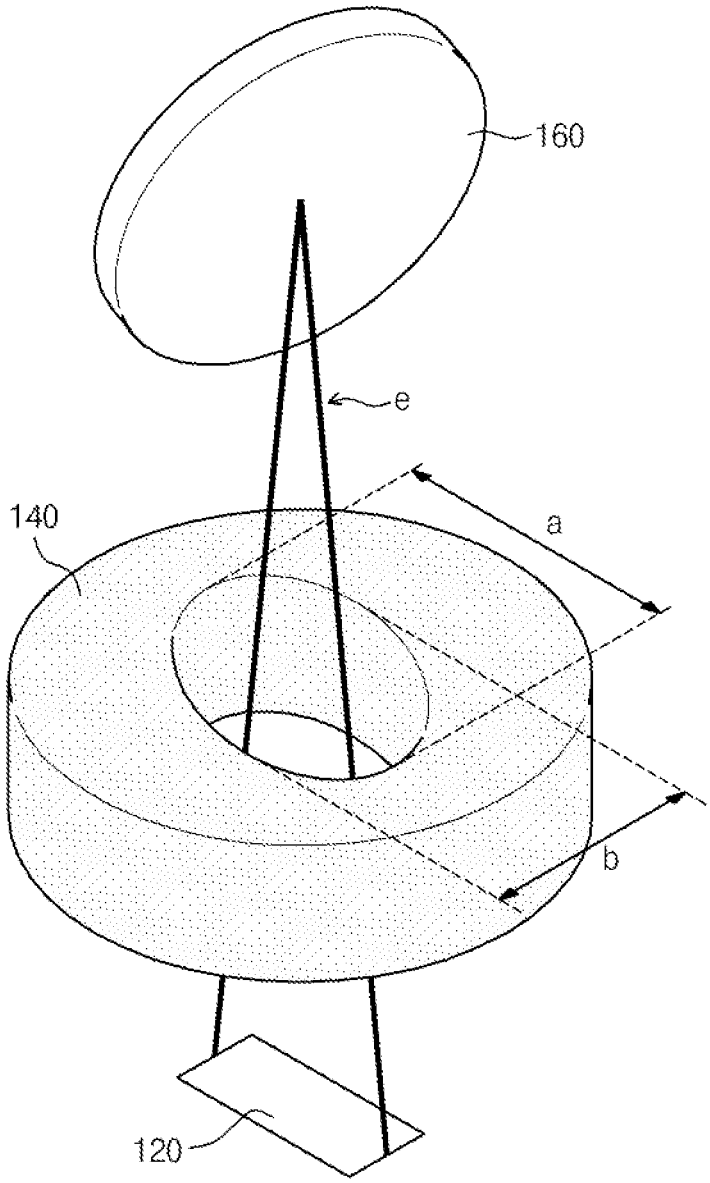
FIG. 6 is a conceptual view for explaining an X-ray tube in accordance with some embodiments of the inventive concept.
Figure 7A:
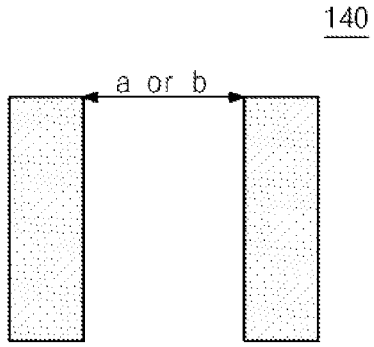
FIGS. 7A through 7C are cross sectional views for explaining the constitution of some parts of X-ray tube in accordance with some embodiments of the inventive concept.
Figure 7B:
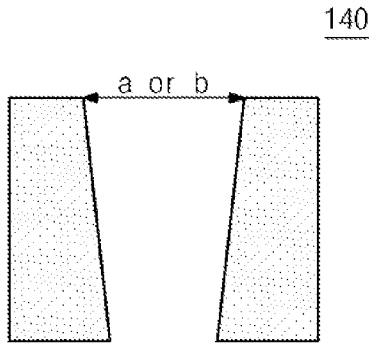
Figure 7C:
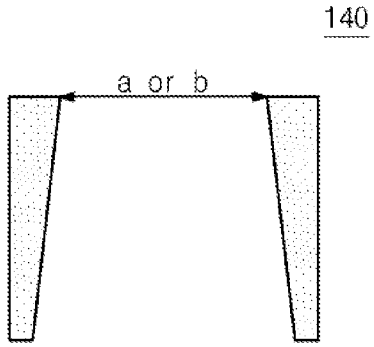

FIG. 6 is a conceptual view for explaining an X-ray tube in accordance with some embodiments of the inventive concept. FIGS. 7A through 7C are cross sectional views for explaining the constitution of some parts of X-ray tube in accordance with some embodiments of the inventive concept.

Referring to FIGS. 6 and 7A through 7C, FIG. 5 illustrates an X-ray tube including an opening of the focusing electrode 140 has a plan cross section of a maximum width (a) and a minimum width (b) different from each other.

FIGS. 7A through 7C illustrates cross sectional views of the focusing electrode 140 of FIG. 6. The opening of one surface of the focusing electrode 140 adjacent to the anode electrode 160 may have a plan cross section of a maximum width (a) and a minimum width (b) different from each other. That is, the opening may have a form penetrating the focusing electrode 140. The opening may have a gradually narrowing or widening width as approaching the anode electrode 160.

Figure 8:
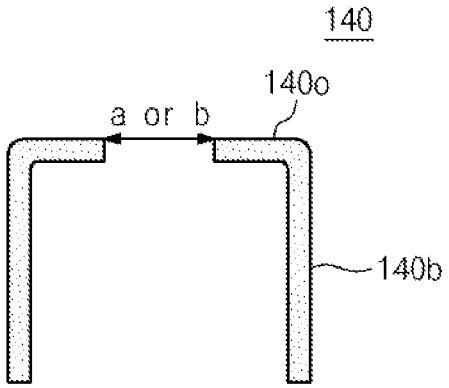
FIG. 8 is cross sectional view for explaining the constitution of some parts of X-ray tube in accordance with some embodiments of the inventive concept.

FIG. 8 is cross sectional view for explaining the constitution of some parts of an X-ray tube in accordance with some embodiments of the inventive concept.

Referring to FIG. 8, the focusing electrode 140 may be comprised of a body portion 140*b* and an opening portion 140*o* including an opening while it is positioned on the body portion 140*b* adjacent to the anode electrode 160. The opening portion 140*o* may extend from the body portion 140*b* to be produced to have an opening of a maximum width (a) and a minimum width (b) different from each other.

Figure 9A:
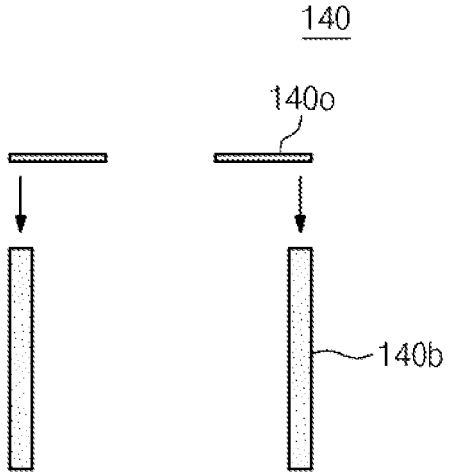
FIGS. 9A and 9B are cross sectional views for explaining the constitution of some parts of X-ray tube in accordance with some embodiments of the inventive concept.
Figure 9B:
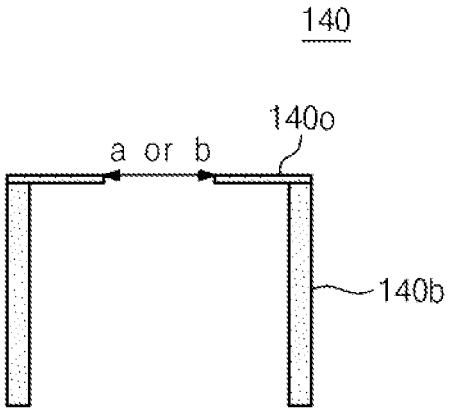

FIGS. 9A and 9B are cross sectional views for explaining the constitution of some parts of an X-ray tube in accordance with some embodiments of the inventive concept.

Referring to FIGS. 9A and 9B, the focusing electrode 140 may be comprised of a body portion 140*b* and an opening portion 140*o* including an opening while it is positioned on the body portion 140*b* adjacent to the anode electrode 160. The opening portion 140*o* may be produced using a sheet having an opening of a maximum width (a) and a minimum width (b) different from each other. That is, the focusing electrode 140 can be produced by electrically connecting the opening portion 140*o* of a sheet shape to the body portion 140*b* adjacent to the anode electrode 160.

Figure 10:
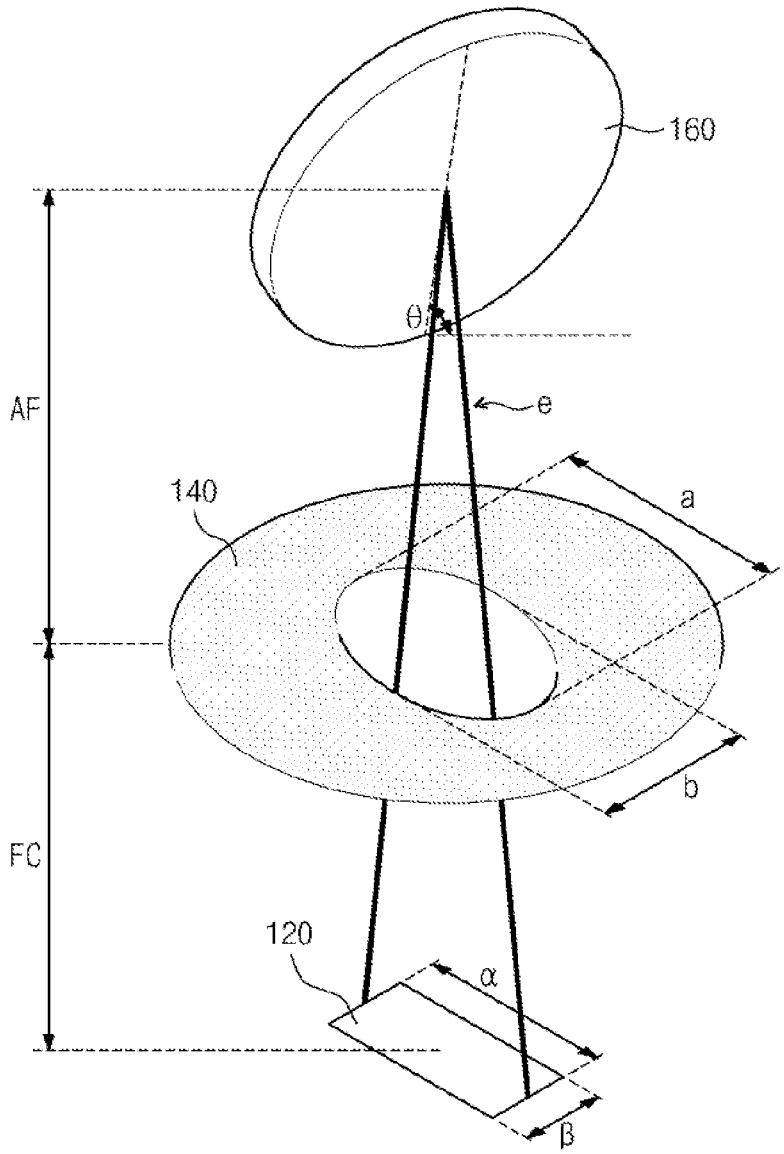
FIGS. 10 through 12 are conceptual views for explaining an X-ray tube in accordance with some embodiments of the inventive concept.
Figure 11:
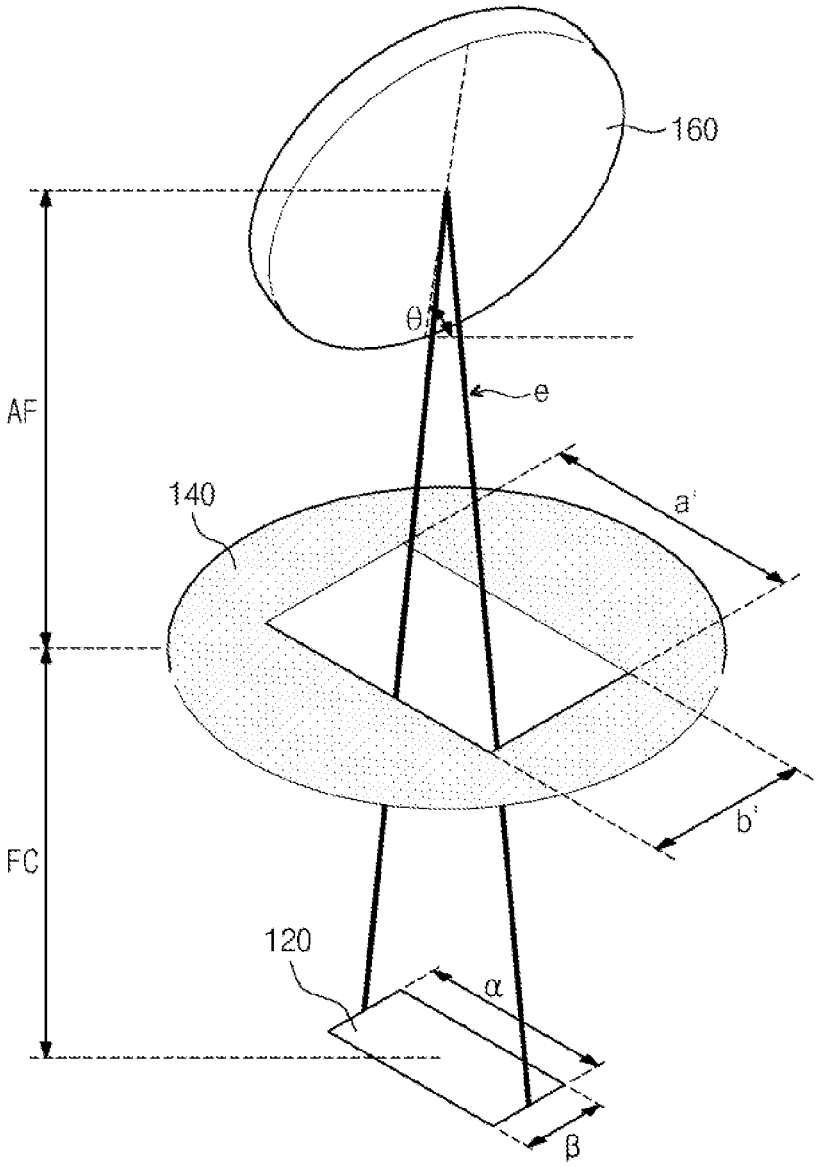
Figure 12:
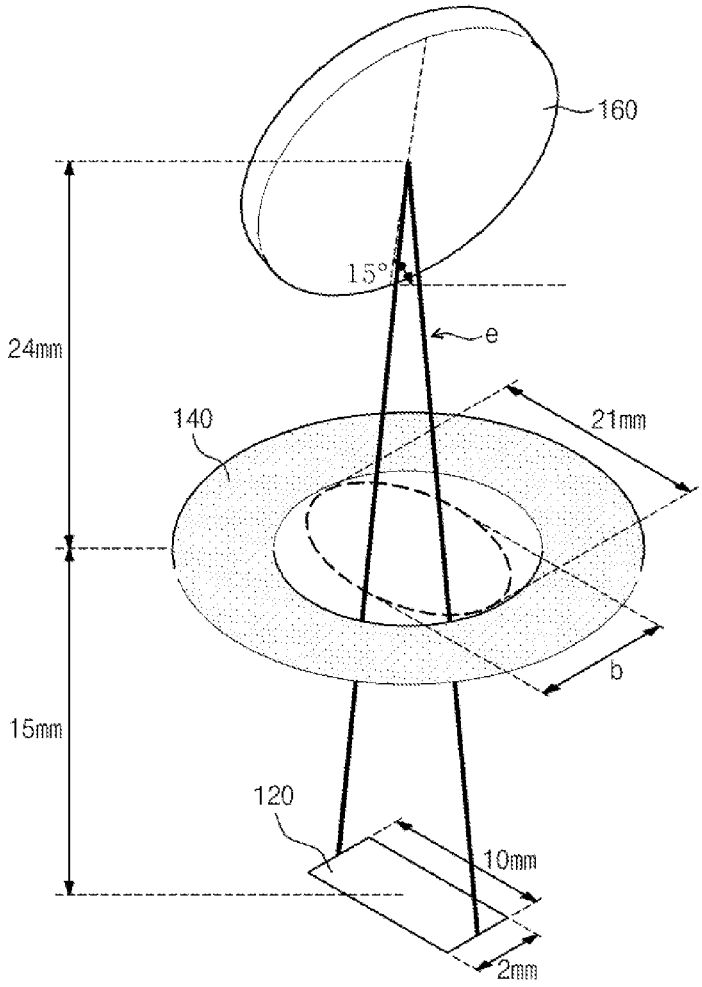

FIGS. 10 through 12 are conceptual views for explaining an X-ray tube in accordance with some embodiments of the inventive concept.

Referring to FIGS. 10 through 12, the X-ray tube may include the focusing electrode 140 of a sheet shape. An opening of the focusing electrode 140 may have an elliptical shape or a rectangular shape. The opening may have a maximum width (a or a') and a minimum width (b or b') different from each other.

A size of the focusing electrode 140 may be determined by a size (a and β), a distance FC between the emitter 120 (or grid, or gate electrode) and the focusing electrode 140, a distance AF between the focusing electrode 140 and the anode electrode 160 and an inclined angle θ of the anode electrode 160.

Figure 13:
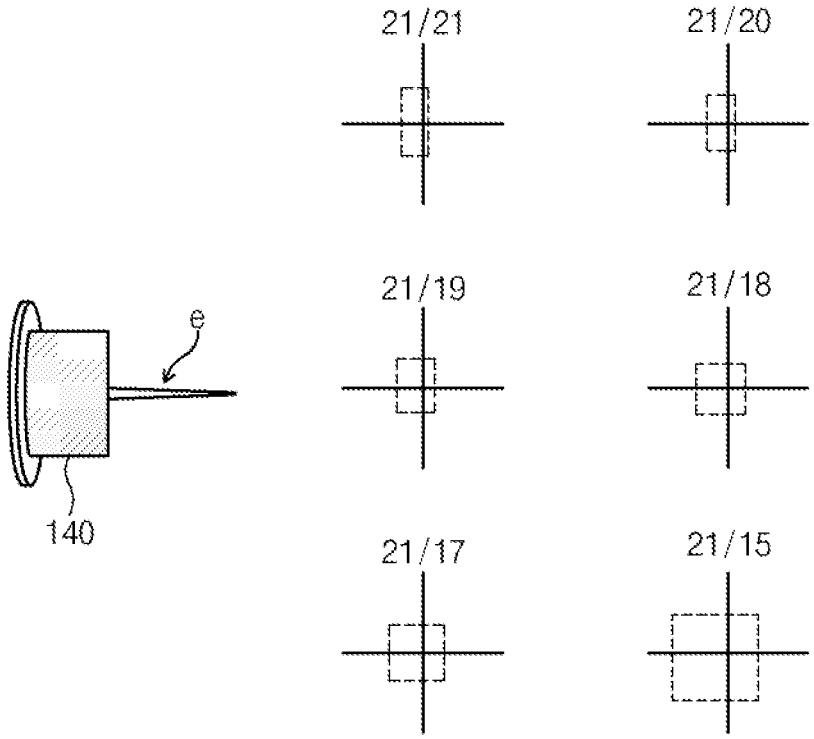
FIGS. 13 and 14 are drawings illustrating simulation results of constitution of some parts of X-ray tube in accordance with some embodiments of the inventive concept.
Figure 14:
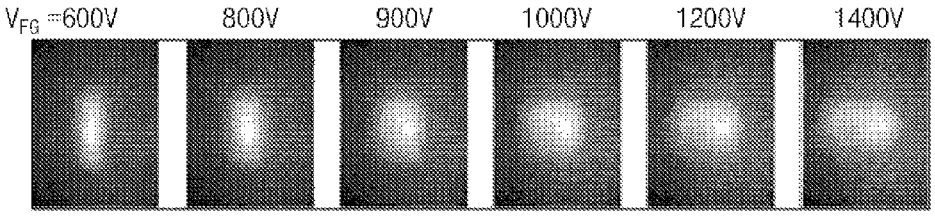

FIGS. 13 and 14 are drawings illustrating simulation results of constitution of some parts of an X-ray tube in accordance with some embodiments of the inventive concept.

Referring to FIG. 13, to determine a length of a minimum width (b) of an opening of the focusing electrode 140 in the X-ray tube having the same size as that in FIG. 12, an electron beam trajectory was calculated using an OPERA-3D simulator. The simulation was performed by changing the minimum width (b) from 15 mm to 21 mm while the maximum width is 21 mm and the rest values are fixed. In case of an opening having a diameter of 21 mm that the maximum width (a) and the minimum width (b) are the same, an X-ray focal spot having a maximum width and a minimum width different from each other is formed and if reducing the minimum width (b), the X-ray focal spot has the same width when the minimum width (b) is 18 mm. If further reducing the minimum width (b), the X-ray focal spot having the same width is formed but a size of the X-ray focal spot becomes large. At this time, voltages of 0 V, 1 kV, 1 kV and 50 kV are applied to the cathode electrode (110 of FIG. 1), the gate electrode (130 of FIG. 1), the focusing electrode 140 and the anode electrode (160 of FIG. 12), respectively. Thus, in the structure like FIG. 12, the minimum width (b) of the opening of the focusing electrode 140 that makes the X-ray focal spot have the same width is 18 mm.

Referring to FIG. 14, in the structure like FIG. 12, when a voltage being applied to the focusing electrode 140 is low, the X-ray focal spot becomes a longish shape in a z direction (an excessive longish electron beam spot in an x direction), when the voltage is around 900V, the X-ray focal spot becomes an optimum shape and if the voltage further increases, the X-ray focal spot becomes a longish shape in a y direction (an electron beam spot having the same width or an electron beam spot having a longish shape in a y direction). Voltages of 0 V, 1 kV and 50 kV are applied to the cathode electrode, the gate electrode and the anode electrode, respectively.

In the X-ray tube in accordance with some embodiments of the inventive concept, the opening of the focusing electrode has a plan cross section of a maximum width and a minimum width different from each other and thereby an electron beam spot focused on the anode electrode may have a maximum width and a minimum width different from each other. Thus, the X-ray tube may be provided which can make a focal spot of X-ray generated from the anode electrode by a strike of an electron beam have a symmetrical form.

A spot form of an electron beam focused on the anode electrode may be changed by changing the maximum width and the minimum width different from each other of the plan cross section of the opening of the focusing electrode. Thus, a focal spot size of the X-ray being generated from the anode electrode by a strike of the electron beam may be controlled.

The above-disclosed subject matter is to be considered illustrative, and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. An X-ray tube comprising:

a cathode electrode disposed in a first end of a vacuum container and including an emitter emitting an electron;

a gate electrode disposed in the vacuum container and adjacent to the cathode electrode;

an anode electrode disposed in a second end of the vacuum container and inclined, at a point where the electron collides with the anode electrode, along an inclined direction with respect to the cathode electrode;

a focusing electrode disposed in the vacuum container along an inner circumference surface of the vacuum container between the gate electrode and the anode electrode; and an opening formed in the focusing electrode, wherein a plan cross section of the opening has a maximum width in the inclined direction and a minimum width different from the maximum width, and wherein the plan cross section of the opening has an elliptical shape.

2. The X-ray tube of claim 1, wherein the opening has a form penetrating the focusing electrode.

3. The X-ray tube of claim 2, wherein the opening has a gradually narrowing or widening width as approaching the anode electrode.

4. The X-ray tube of claim 1, wherein the focusing electrode comprises:

a body portion of cylindrical shape disposed in the vacuum container along the inner circumference surface of the vacuum container; and an opening portion having the opening while it is positioned on the body portion adjacent to the anode electrode.

5. The X-ray tube of claim 1, wherein a maximum width of a plan cross section of the emitter is different from a minimum width of the plan cross section of the emitter.

6. The X-ray tube of claim 5, wherein the maximum width of the plan cross section of the emitter coincides with the inclined direction of the anode electrode.

7. The X-ray tube of claim 1, wherein the plan cross section of the emitter has an elliptical shape or a polygonal shape.

8. The X-ray tube of claim 1, wherein a size of the plan cross section of the opening is determined by a size of the emitter, a distance between the emitter and the focusing electrode or between the gate electrode and the focusing electrode, a distance between the focusing electrode and the anode electrode, or a degree of inclination of the anode electrode.

9. The X-ray tube of claim 8, wherein the emitter is a hot cathode electron source or a cold cathode electron source.

10. A method of controlling an X-ray focal spot of an X-ray tube having the structure of claim 1 comprising:

changing the maximum width or the minimum width of the plan cross section of the opening of the focusing electrode.

11. The method of claim 10, wherein the maximum width of the plan cross section of the opening coincides with an inclined direction of the anode electrode.

12. The method of claim 10, wherein a size of the plan cross section of the opening is determined by a size of the emitter, a distance between the emitter and the focusing electrode or between the gate electrode and the focusing electrode, a distance between the focusing electrode and the anode electrode, or a degree of inclination of the anode electrode.

* * * * *